US006402185B1

(12) United States Patent
Buquet

(10) Patent No.: US 6,402,185 B1
(45) Date of Patent: Jun. 11, 2002

(54) SAFETY BINDING FOR A SKI BOOT

(75) Inventor: Thierry Buquet, Varennes Vauzelles (FR)

(73) Assignee: Look Fixations S. A., Nevers (FR)

( * ) Notice: Subject to any disclaimer, the term of this patent is extended or adjusted under 35 U.S.C. 154(b) by 0 days.

(21) Appl. No.: 09/103,153

(22) Filed: Jun. 22, 1998

(30) Foreign Application Priority Data

Jun. 26, 1997 (FR) ..... 97 08311

(51) Int. Cl.[7] ..... A63C 9/08
(52) U.S. Cl. ..... 280/626; 280/623
(58) Field of Search ..... 280/628, 632, 280/626, 623, 635; 4/443; 264/32

(56) References Cited

U.S. PATENT DOCUMENTS 2,364,620 A * 12/1944 Crocker et al. ..... 280/626
3,512,797 A * 5/1970 Marker et al. ..... 280/626
4,113,277 A * 9/1978 Zoor ..... 280/626
4,753,452 A * 6/1988 Boussemart et al. ..... 280/628
5,044,658 A * 9/1991 Challande et al. ..... 280/634
5,333,892 A * 8/1994 Stritzl et al. ..... 280/625
5,864,895 A * 2/1999 Ota et al. ..... 4/443

FOREIGN PATENT DOCUMENTS

FR 2631244 * 5/1988
FR 2631244 * 2/1989 ..... 280/651

* cited by examiner

*Primary Examiner*—Lanna Mai
*Assistant Examiner*—Hau Phan
(74) *Attorney, Agent, or Firm*—John Moettelli; Bugnion S. A.

(57) ABSTRACT

A binding having a binding body which has, mounted in it, at least one return spring, adjustable means for prestressing the spring, and means for indicating the prestress of the spring which consist of a cursor linked kinematically with the prestressing means and a graduation in front of which the cursor moves, the gradation and the cursor being covered by a transparent part. The body is at least partially covered with a casing (18) that forms a protective cap and has at least one transparent region in front of the gradation.

8 Claims, 3 Drawing Sheets

SAFETY BINDING FOR A SKI BOOT

FIELD OF THE INVENTION

The present invention relates to a safety binding for a ski comprising a binding body which has, mounted in it, a return spring, adjustable means for prestressing the spring, and means for indicating the prestress of the spring which consist of a cursor linked kinematically with the prestressing means and a graduation in front of which the cursor moves, the graduation and the cursor being covered by a transparent part.

PRIOR ART

Several bindings of this type are known. The body of the binding has a cutout occupied by a label which bears the graduation, this label being covered by a transparent plate fixed in the cutout. A binding of this type is described, for example, in the patent application FR 2 740 695 in the name of the applicant.

In the binding described in patent FR 2 684 887, the label is fixed under the bottom of a transparent cup which is engaged in a cutout in the body of the binding and is covered by a transparent plate.

In addition to the cursor, the bindings according to the prior art are therefore equipped with a label and a transparent plate. This plate can be fixed in such a way as to ensure that the region of the label is watertight, but the inside of the binding remains exposed to snow and ice. In addition, a vacuum is formed between the label and the transparent plate, which weakens this plate. Further, in the event of impact, the transparent plate may be dislodged from its housing.

SUMMARY OF THE INVENTION

The objects of the invention are, on the one hand, to simplify the structure of the protection of the body, and of the means for displaying the prestress of the spring, and, on the other hand, to improve the watertightness of the body of the binding in order to obtain a structure which withstands impacts better.

The safety binding according to the invention is one wherein the body is at least partially covered with a casing which forms a protective cap and has at least one transparent region in front of the graduation.

The display means no longer comprise a label and the transparent plate is replaced by the transparent part of the casing. The latter is preferably in contact with the body via at least the greater part of its internal surface, so that it bears against the body and thus withstands impacts better.

According to a particular variant, the graduation is fixed directly to the body.

In the case of a pivot binding for binding the heel, a binding which comprises a cylindrical binding body secured rigidly to a sole grip, the casing is preferably in the form of a cylindrical cover which completely surrounds the body of the binding. This cover may also locally have recesses, for example a local recess for engaging a stick directly on the body when manually opening the binding.

The casing may be entirely or partially transparent, for example transparent only in the display region, and opaque or translucent in the other regions.

In order to make the casing, use is preferably made of synthetic materials which can be obtained in transparent form, for example polyurethanes, acrylates, polyamides and the like.

In the case of a variant in which the casing includes translucent or opaque regions, at least two different materials are used for manufacturing it, including one material for the transparent part and another material for forming the opaque or translucent regions.

According to another particular variant, the transparent region may be formed in such a way as to create a lens effect, an effect which makes it easier to read the graduation.

BRIEF DESCRIPTION OF THE DRAWINGS

By way of example, the appended drawing represents an embodiment of the invention.

DESCRIPTION OF THE PREFERRED EMBODIMENTS

Figure 1:
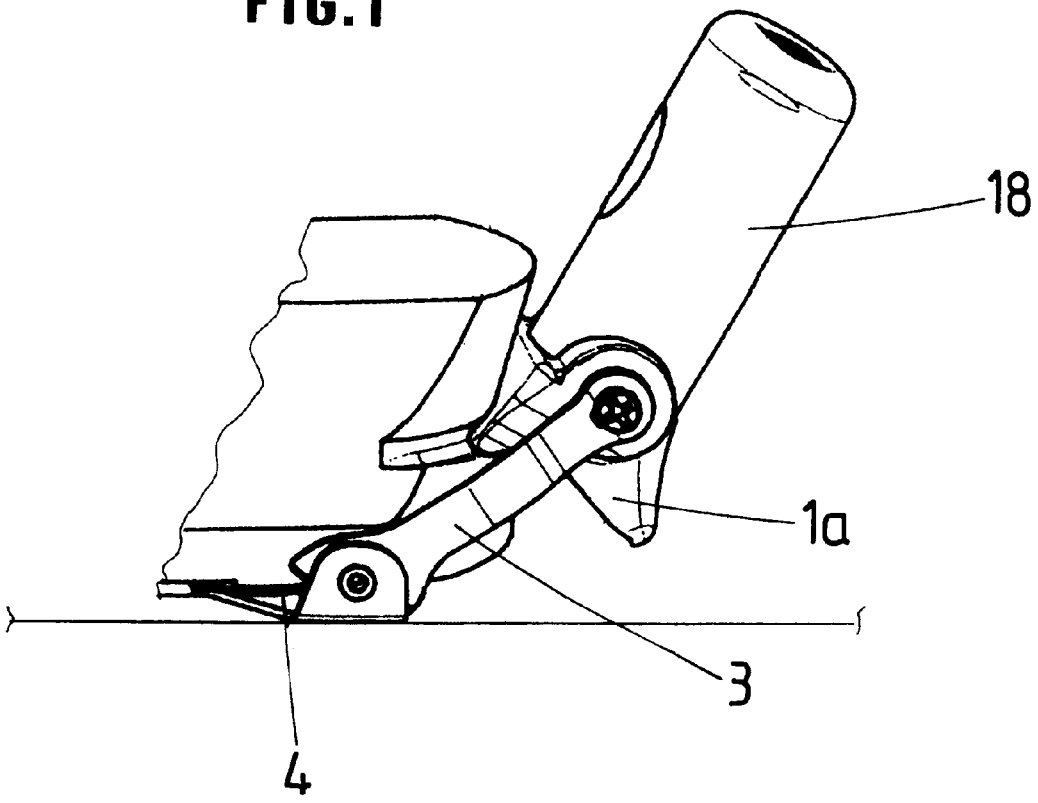
FIG. 1 is a perspective representation of a rear binding, referred to as a pivot binding, when closed on a boot.
Figure 2:
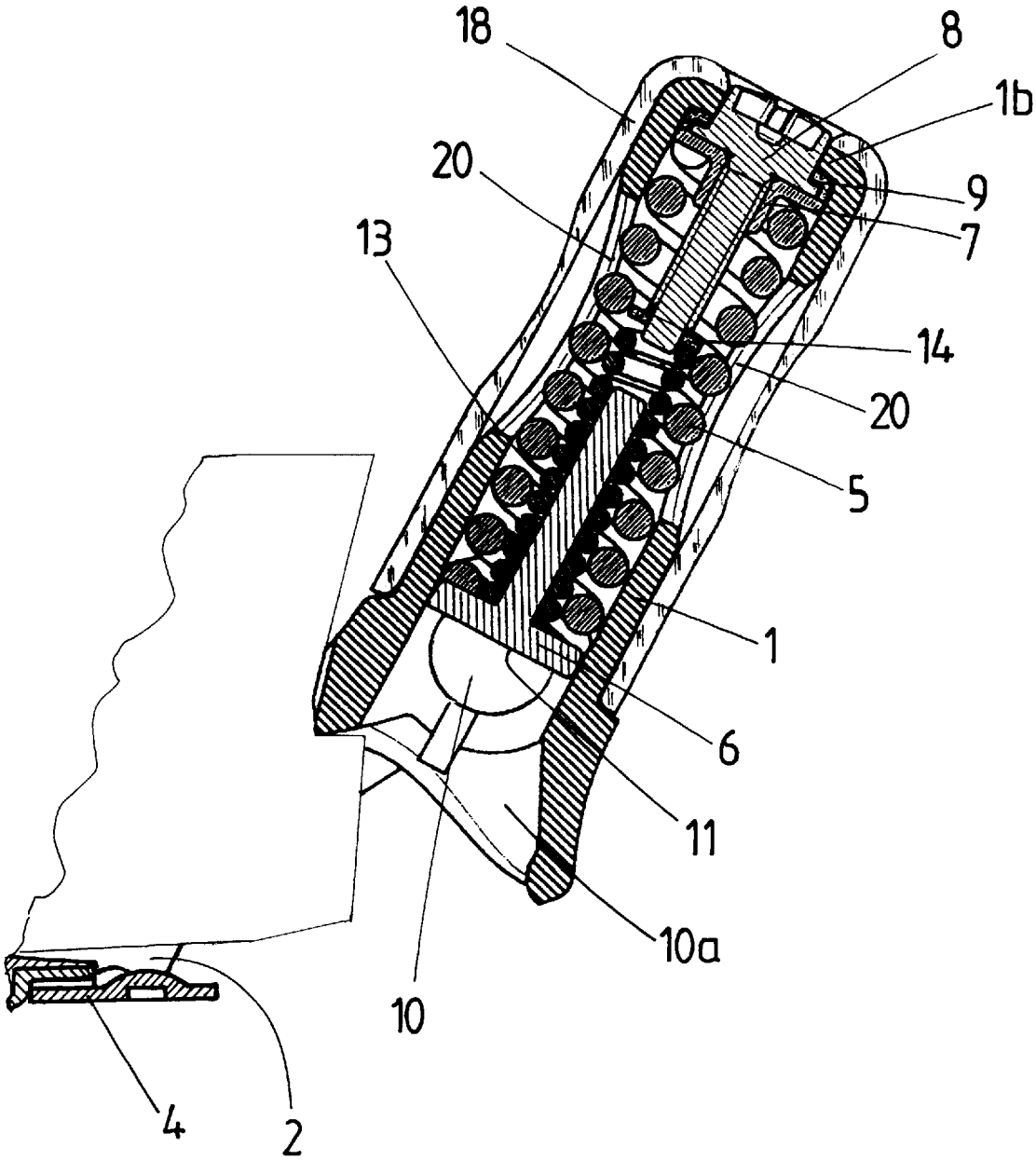
FIG. 2 is an axial section, on a vertical plane, of the body of the binding represented in FIG. 1.
Figure 3:
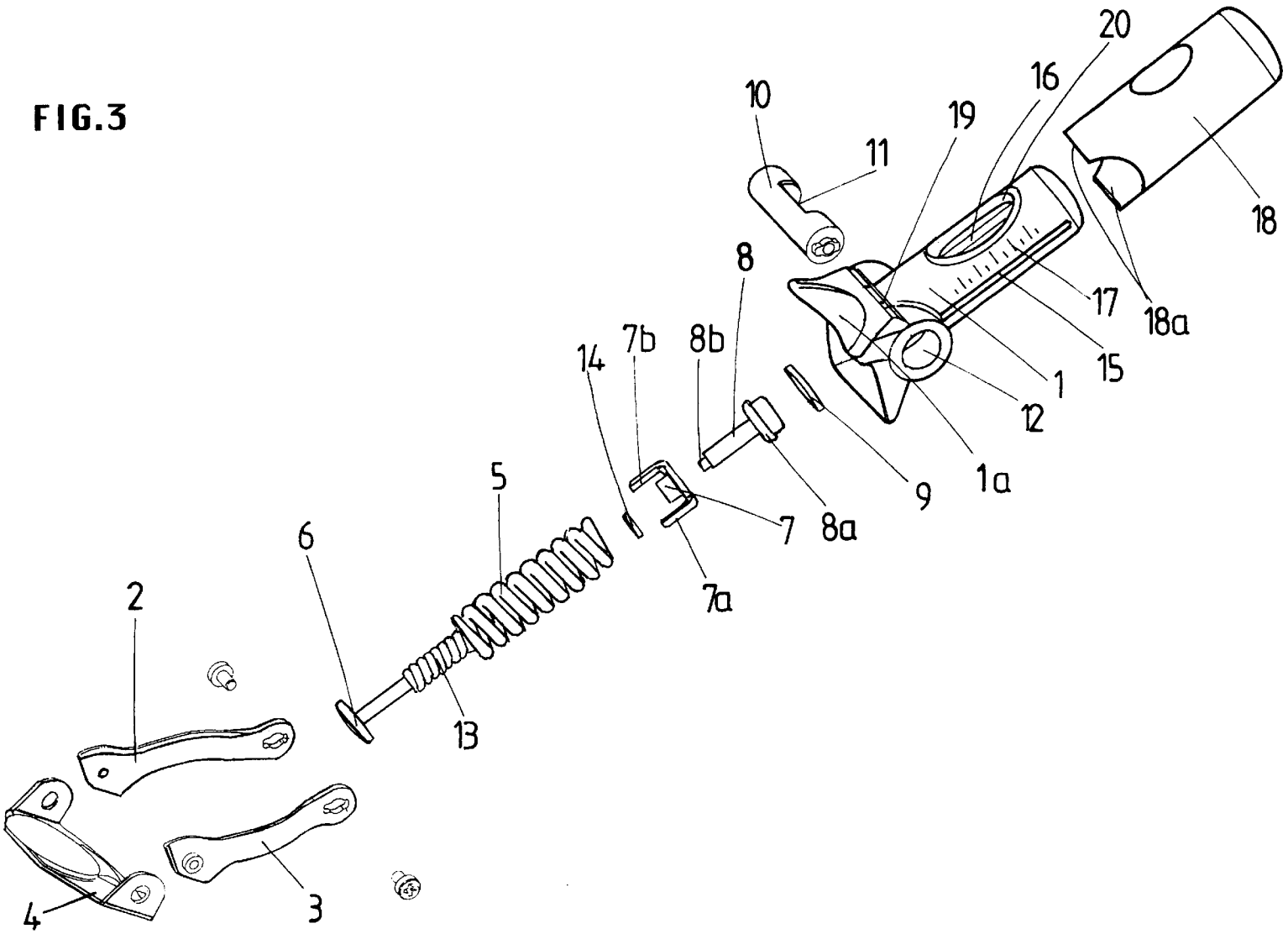
FIG. 3 is an exploded view of the binding.

The binding which is represented is a binding of the pivot type, as described in patent CH 397 500. This type of binding is characterized by a tubular binding body 1 integral with a sole grip 1*a*. This body 1 is connected by two arms 2 and 3 to a pivoting plate 4. It contains a main coil spring 5, referred to as the setting spring working in compression between a piston 6 and a stop 7. The latter is in the form of a nut mounted on a screw 8 provided with a collar 8*a* through which the screw bears on the shoulder 1*b* of the body 1 surrounding the upper opening in the body 1 (FIG. 2). A sliding washer 9 is interposed between the collar 8*a* and the bearing surface 1*b*. The piston 6 bears, via a flat 11, on a cam 10 formed on a cylindrical shaft which passes diametrically through the body 1. The arms 2 and 3 are fixed to the ends of this cam 10 by parts which are profiled in such a way as to prevent the cam 10 from rotating. In known fashion, it is in fact the body 1 which rotates about the cam 10 by virtue of a bore 12. Mounted inside the spring 5, there is also an auxiliary spring 13, referred to as the setting spring 2, which works in compression between the piston 6 and a washer 14 held on a bearing surface 8*b* of the end of the screw 8.

The body 1 has two longitudinal slits 15 and 16 which are parallel to the axis of the springs and of the screw, and are arranged on each side of the body 1. The cursor 7 is provided with two arms 7*a* and 7*b* which are engaged in the slits 15 and 16, respectively, and can slide freely in these slits. Graduations 17 are etched on the edges of these slits 15 and 16, and make it possible to read the position of the cursor 7. These graduations are accompanied by numbers indicating the setting of the binding.

The cylindrical body 1 is surrounded by a casing 18 which is in the form of a cylindrical cover and also has an opening at its end in order to access the adjustment screw 8. This cover 18 is made of a transparent synthetic material, for example polyurethane, acrylate or a polyamide, so that it makes it possible to read the setting of the binding. The internal diameter of the cover 18 is substantially equal to the diameter of the body 1, so that it is in contact with the body 1 over its entire internal surface. The internal diameter may be slightly less than the diameter of the body 1 so as to clamp the body 1 slightly, which holds it on the body 1. It would, however, be possible to shape the edges 18*a* of the cover 18 in such a way that it hooks under notches 19 formed on the body 1.

The casing could be fixed by shrinking, in particular by heat-shrinking.

In the embodiment which is represented the body 1 has one or two cutouts 20 allowing the spring to be seen.

The cover 18 may be made opaque or translucent outside the display region.

The cursor 7 could, of course, be provided with a single arm, and the body 1 could have a single slit 15 or 16.

The arrangement according to the invention is applicable to a binding for the front end of the boot. In this case, for technical design reasons, the casing, at least in its transparent part, does not completely surround the body of the binding, but forms a cap which covers the top and the sides of the body of the binding.

The arrangement according to the invention is also applicable to a conventional binding for the rear end of a boot, a binding which is commonly referred to as a heel piece.

What is claimed is:

1. A safety binding for a ski comprising a pair of arms pivotably attached to a ski and a pivotable binding body (1) pivotably attached to the pair of arms, the binding body including therein at least one return spring (5), adjustable means (7, 8) for prestressing the spring, and means for indicating the prestress of the spring, the indicating means comprising a cursor **(7*a*) linked kinematically with the prestressing means and viewable through openings in the binding body and graduations (17), the cursor moving relative to the graduation on an exterior of the binding body, the safety binding characterized in that the binding body is at least partially covered with a cylindrical casing (18)**, the casing a) having at least one transparent region spanning the openings in the binding body through which the cursor and the graduations are visible, and b) forming a snug, transparent cap protecting against encroachments of moisture into the binding body.

2. The safety binding as claimed in claim 1, wherein the graduations (17) are fixed directly to the binding body (1).

3. The binding as claimed in claim 1, for binding the heel to the boot, wherein the cylindrical binding body (1) is secured rigidly to a sole grip **(1*a*), and wherein said casing (18)** completely surrounds the body of the binding.

4. The safety binding as claimed in claim 3, wherein the openings in the binding body (1) includes at least one longitudinal slit (15, 16), and the cursor (7) has at least one arm **(7*a*, 7*b*)**, the arm moving in said slit.

5. The safety binding as claimed in claim 1, wherein the casing (18) is entirely transparent.

6. The safety binding as claimed in claim 1, wherein the casing (18) includes translucent or opaque regions.

7. The safety binding as claimed in claim 6, wherein the casing is made of at least two different materials, one material forming the transparent part and another material forming the translucent or opaque regions.

8. The safety binding as claimed in claim 1, wherein the transparent region is formed in such a way as to create a lens effect.

* * * * *